US005468405A

United States Patent [19]

Klein et al.

[11] Patent Number: 5,468,405

[45] Date of Patent: Nov. 21, 1995

[54] USE OF PARTIALLY DEHYDRATED CASTOR OILS AS LUBRICANTS

[75] Inventors: Johann Klein; Frank Bongardt, both of Duesseldorf; Karl-Heinz Schmid, Mettmann, all of Germany

[73] Assignee: Henkel Kommanditgesellschaft auf Aktien, Duesseldorf, Germany

[21] Appl. No.: 244,356

[22] PCT Filed: Nov. 19, 1992

[86] PCT No.: PCT/EP92/02663

§ 371 Date: May 26, 1994

§ 102(e) Date: May 26, 1994

[87] PCT Pub. No.: WO93/11207

PCT Pub. Date: Jun. 10, 1993

[30] Foreign Application Priority Data

Nov. 27, 1991 [DE] Germany ..... 41 38 910.7

[51] Int. Cl.[6] ..... C10M 129/76

[52] U.S. Cl. ..... 252/56 R; 252/79

[58] Field of Search ..... 252/56 R, 79

[56] References Cited

U.S. PATENT DOCUMENTS

| | | | |
|---|---|---|---|
| 1,782,501 | 11/1930 | Clough | 252/56 R |
| 1,892,258 | 12/1932 | Ufer | 252/56 R |
| 2,225,552 | 12/1940 | Colberth | 252/56 R |
| 2,361,022 | 10/1944 | Gilbert | 252/56 R |
| 2,371,656 | 3/1945 | Smith | 252/56 R |
| 2,484,328 | 10/1949 | Agster et al. | 260/405.5 |

FOREIGN PATENT DOCUMENTS 0671368 5/1952 United Kingdom .

OTHER PUBLICATIONS

Ullmann's Enzyclopädie der technischen Chemie, vol. 20, pp. 457–671, 1984 month unavailable.

"Fette und Seifen", No. 9, 425 (1943) Sep.

*Primary Examiner*—Jacqueline V. Howard

*Attorney, Agent, or Firm*—Wayne C. Jaeschke; Norvell E. Wisdom, Jr.; Henry E. Millson, Jr.

[57] ABSTRACT

Partially dehydrated castor oils having hydroxyl numbers in a range between 90 and 150 mg of KOH/g are useful as lubricants.

19 Claims, No Drawings

USE OF PARTIALLY DEHYDRATED CASTOR OILS AS LUBRICANTS

FIELD OF THE INVENTION

This invention relates to the use of partly dehydrated castor oils as lubricants.

STATEMENT OF RELATED ART

It has long been known that synthetic ester oils can be used both as a base oil and also as an additive to lubricants. By comparison with the less expensive, but ecologically less sale mineral oils, synthetic ester oils are generally used as a base oil when better viscosity/temperature behavior and a lower pour point are required. Thus, in civil and military aviation for example, turbine oils based on synthetic ester oils of adipic acid, azelaic acid and/or sebacic acid with alkanols have long played a significant role (see *Ullmann's Enzyclopädie der technischen Chemie* [Title in English: Ulmann's Encyclopedia of Technological Chemistry], Vol. 20, pages 457–671, 1984). However, not only synthetic ester oils, but also natural esters, such as technical castor oil with hydroxyl values of 160 to 170 mg KOH/g, have already been used as a base oil for high-performance engines, such as racing engines, by virtue of their extremely good lubricating properties. However, with continual increases in engine performance, lubricants and, more particularly, the base oils of lubricants are having to meet steadily increasing requirements. Thus, the lubricants are not only supposed to reduce wear, for example of metal parts, they are also supposed to enable the metal parts to be exposed to higher pressures without seizing. However, this particular property, which is also known as the extreme-pressure property, is hardly pronounced in the case of technical castor oil.

DESCRIPTION OF THE INVENTION

Object of the Invention

For reasons of cost, however, synthetic and even natural esters are not only used as a base oil, but often as an additive to minimize wear (anti-wear) or the risk of seizing (extreme pressure). In cases such as these, only small quantities of ester are added to known lubricants, such as mineral oils. Although the synthetic or natural esters known from the prior art have good lubricating properties which reduce wear, there is still a considerable demand for new esters which minimize seizing more effectively than known esters. In addition, the esters should be of natural origin and should be readily available and biodegradable. The esters should also show excellent low-temperature behavior where they are used as a base oil.

The problem addressed by the present invention was to provide esters which would satisfy this requirement.

SUMMARY OF THE INVENTION

The present invention relates to the use of partly dehydrated castor oils with hydroxyl values of 90 to 150 mg KOH/g as lubricants.

DESCRIPTION OF THE PREFERRED EMBODIMENTS

The partly dehydrated castor oils used in accordance with the invention may be produced in known manner by dehydration of castor oil with hydroxyl values of 160 to 170 mg KOH/g in the presence of acidic catalysts, such as sulfuric acid, phosphoric acid, acid anhydrides, metal oxides showing an acidic reaction or hydrogen-containing salts showing an acidic reaction, such as sodium hydrogen sulfate, at temperatures of 200° to 300° C., with removal of water. Overviews on the dehydration of castor oil can be found in *Farbe und Lack* 57, 149 (1951) and in *Fette und Seifen,* No. 9, 425 (1943). For the purposes of the present invention, the partly dehydrated castor oils are preferably obtained from castor oil using phosphorous acid in accordance with GB 671,368, preferably in the presence of 0.1 to 1% by weight, and more preferably in the presence of about 0.25 to 0.75% by weight, based on castor oil, of phosphorous acid, and at temperatures in the range from 230° to 260° C. The required hydroxyl value of 90° to 150 mg KOH/g of the partly dehydrated castor oils can be adjusted on the one hand through the quantities of phosphorous acid used and, above all, through the reaction time. In principle, it may be said that, the longer the reaction time, the lower the hydroxyl value obtained, the reaction time being reducible by addition of phosphorous acid in quantities within the range mentioned above. In general, the reaction with phosphorous acid in the quantities mentioned above over reaction times of about 30 minutes to 10 hours leads to partly dehydrated castor oils with hydroxyl values in the required range. It is important in this regard to remember that the hydroxyl values are always average hydroxyl values, which are determined by *DGF-Einheitsmethode* C-V 17a (1953) and which are expressed in mg KOH/g.

Partly dehydrated castor oils with hydroxyl values of 100 to 140, and preferably 110 to 130 mg KOH/g, are preferred for the purposes of the invention. Although partly dehydrated castor oils with hydroxyl values below 90 also have a lubricating effect, it is distinctly poorer. Thus, seizing in the presence of these highly dehydrated castor oils is even worse than in the presence of natural castor oils.

According to the invention, the partly dehydrated castor oils may be used both as a base oil and as an additive. Accordingly, the expression "lubricant" in the context of the invention encompasses both base oils and also additives with lubricating properties. In both fields of application, the partly dehydrated castor oils used in accordance with the invention may be used with known base oils, such as mineral oils, synthetic ester oils of dicarboxylic acids and alkanols or dicarboxylic and monocarboxylic acids and alkanols and with natural esters, such as triglycerides. The percentage content of the partly dehydrated castor oils used in accordance with the invention is determined by the intended effect. As a base oil, the partly dehydrated castor oils are preferably used in quantities of 50 to 100% by weight, based on the additive containing lubricant. Where they are used as an additive, the partly dehydrated castor oils are used in quantities of from about 0.1 to 20% by weight and preferably in quantities of 5 to 10% by weight, based on the additive containing lubricant.

By virtue of their favorable tribological properties, the partly dehydrated castor oils may be used either on their own or in combination with known lubricants in engine oil, transmission oil, hydraulic and/or cooling lubricant fluids. In a particularly preferred embodiment, the partly dehydrated castor oils are used on their own as a base oil in engine oil fluids, preferably in racing engine oil fluids.

The partly dehydrated castor oils used in accordance with the invention with hydroxyl values in the range mentioned above have extremely good lubricating properties and, above all, excellent extreme-pressure properties. In addition, the partly dehydrated castor oils show excellent viscosity/temperature behavior which is also reflected in the pour points of around −20° to −40° C., as determined in accordance with DIN ISO 3016. In addition, the partly dehydrated castor oils have a good adhering effect at sufficiently high viscosities.

If the partly dehydrated castor oils are used as a base oil, it is obvious that such additives as oxidation and corrosion inhibitors, dispersants, high-pressure additives, antifoam agents, metal deactivators may also be added in the usual effective quantities to improve the lubricity of the base oil.

EXAMPLES

A) Production of partly dehydrated castor oils

Example 1

3 kg of a commercial castor oil (OH value approximately 160, saponification value approximately 180, iodine value approximately 85, acid value approximately 2) were introduced into a reactor and, after the addition of 7.5 g of phosphorous acid, were heated in vacuo (15 torr) to 240° C. Depending on the reaction time, partly alehydrated castor oils with the following characteristic data were obtained, OHV being the hydroxyl value in mg KOH/g, SV being the saponification value according to DIN 53401, IV being the iodine value as determined in accordance with DGF CV, 11b and AV being the acid value according to DIN 53402.

TABLE I

| | Reaction product | | | |
|---|---|---|---|---|
| Reaction time (hours) | OHV | SV | IV | AV |
| 1 | 147 | 184 | 90 | 2.6 |
| 2 | 133 | 184 | 95 | 2.7 |
| 3 | 120 | 185 | 96 | 2.3 |
| 4 | 107 | 186 | 102 | 2.0 |
| 5 | 95 | 187 | 106 | 1.6 |

Example 2

3 kg of commercial castor oil were reacted with 15 g of phosphorous acid at 240° C. as in Example 1. Depending on the reaction time, partly alehydrated castor oils with the characteristic data shown in Table II were obtained.

TABLE II

| | Reaction product | | | |
|---|---|---|---|---|
| Reaction time (hours) | OHV | SV | IV | AV |
| 1 | 132 | 186 | 89 | 2.3 |
| 1.5 | 120 | 187 | 93 | 2.2 |
| 2 | 109 | 188 | 97 | 1.9 |
| 2.5 | 101 | 189 | 99 | 2.0 |
| 3 | 92 | 190 | 102 | 1.9 |
| 3.5 | 79 | 190 | 114 | 2.0 |

Performance Properties

Using a 4-ball apparatus according to DIN 51350,

I) commercial castor oil (OH value approximately 160, saponification value approximately 180, iodine value approximately 85, acid value approximately 2), II) partly dehydrated castor oil according to Example 1 with a reaction time of 3 hours, i.e. with a hydroxyl value of 120, a saponification value of 185, an iodine value of 96 and an acid value of 2.3, III) partly dehydrated castor oil according to Example 2 with a reaction time of 3.5 hours, i.e. with an OH value of 79, a saponification value of 190, an iodine value of 114 and an acid value of 2.0 were tested for their anti-wear properties. The anti-wear properties at 600 and 450 N and the extreme-pressure properties are set out in Table 1. It can be seen that partly dehydrated castor oil with a hydroxyl value of 120 has a very much better lubricating effect than technical castor oil and partly dehydrated castor oil with an OH value of 79. In addition, the extreme-pressure properties of partly alehydrated castor oil with a hydroxyl value of 120 are far superior at 1900 N than those of the technical castor oil used for comparison.

TABLE 1

Anti-wear/extreme-pressure properties according to DIN 51350

| | Anti-wear as wear in mm | | Extreme pressure |
|---|---|---|---|
| Compound | at 450 N | at 600 N | at |
| I | 0.5 | 0.8 | 1100 |
| II | None | 0.5 | 1900 |
| III | 0.6 | n.d. | n.d. |

n.d. = not determined

The invention claimed is:

1. In a process of lubricating, the improvement wherein the lubricant used therein contains a partly dehydrated castor oil with an hydroxyl value in the range of from 110 to 130 mg KOH/g.

2. A process as claimed in claim 1, wherein the partly dehydrated castor oil is present in combination with other lubricants in engine oil, transmission oil, hydraulic fluids, or cooling lubricant fluids.

3. A process as claimed in claim 2, wherein the partly dehydrated castor oil is present as a base oil in a racing engine oil fluid.

4. A process as claimed in claim 3, wherein the partly dehydrated castor oil has been produced by reaction of castor oil having a hydroxyl value of 160 to 170 mg KOH/g with an acidic catalyst at a temperature of 200° to 300° C., with removal of water.

5. A process as claimed in claim 2, wherein the partly dehydrated castor oil is present as a base oil in an engine oil fluid.

6. A process as claimed in claim 1, wherein the partly dehydrated castor oil is present as a base oil in an engine oil fluid.

7. A process as claimed in claim 1, wherein the partly dehydrated castor oil is present as a base oil in an engine oil fluid.

8. A process as claimed in claim 7, wherein the partly dehydrated castor oil has been produced by reaction of castor oil having a hydroxyl value of 160 to 170 mg KOH/g with an acidic catalyst at a temperature of 200° to 300° C., with removal of water.

9. A process as claimed in claim 6, wherein the partly dehydrated castor oil has been produced by reaction of castor oil having a hydroxyl value of 160 to 170 mg KOH/g with an acidic catalyst at a temperature of 200° to 300° C., with removal of water.

10. A process as claimed in claim 5, wherein the partly dehydrated castor oil has been produced by reaction of castor oil having a hydroxyl value of 160 to 170 mg KOH/g with an acidic catalyst at a temperature of 200° to 300° C., with removal of water.

11. A process as claimed in claim 2, wherein the partly dehydrated castor oil has been produced by reaction of castor oil having a hydroxyl value of 160 to 170 mg KOH/g with an acidic catalyst at a temperature of 200° to 300° C., with removal of water.

12. A process as claimed in claim 1, wherein the partly dehydrated castor oil has been produced by reaction of castor oil having a hydroxyl value of 160 to 170 mg KOH/g with an acidic catalyst at a temperature of 200° to 300° C., with removal of water.

13. In a lubricant containing a base oil, the improvement wherein the base oil contains a lubricating quantity of a partly dehydrated castor oil having a hydroxyl value in the range of from 110 to 130 mg KOH/g.

14. The lubricant of claim 13 wherein said lubricating quantity is from 50 to 100% by weight of the base oil.

15. The lubricant of claim 13 wherein the lubricant is an engine oil, a transmission oil, a hydraulic fluid, or a cooling lubricant fluid.

16. The lubricant of claim 13 wherein the lubricant is an engine oil wherein the base oil consists essentially of the partly dehydrated castor oil,

17. In a lubricant containing a base oil, the improvement wherein from 0.1 to 20% by weight of a partly dehydrated castor oil having a hydroxyl value in the range of from 110 to 130 mg KOH/g, based on the weight of the lubricant, is present in the lubricant.

18. The lubricant of claim 17 wherein from 5 to 10% by weight of the partly dehydrated castor oil is present therein.

19. The lubricant of claim 17 wherein the lubricant is an engine oil, a transmission oil, a hydraulic fluid, or a cooling lubricant fluid.

* * * * *